US007902955B2

(12) United States Patent
Veneruso et al.

(10) Patent No.: US 7,902,955 B2
(45) Date of Patent: Mar. 8, 2011

(54) PROVIDING AN INDUCTIVE COUPLER ASSEMBLY HAVING DISCRETE FERROMAGNETIC SEGMENTS

(75) Inventors: Anthony F. Veneruso, Paris (FR); Christian Chouzenoux, Saint Cloud (FR); Fabien Cens, Massy (FR); Sara Escanero, Paris (FR); Dinesh R. Patel, Sugar Land, TX (US); Jean Luc Garcia, Courcouronnes (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 487 days.

(21) Appl. No.: 11/865,768

(22) Filed: Oct. 2, 2007

(65) Prior Publication Data

US 2009/0085701 A1 Apr. 2, 2009

(51) Int. Cl.

| | |
|---|---|
| ***H01F 27/24*** | (2006.01) |
| ***H01F 38/20*** | (2006.01) |
| ***H01F 17/06*** | (2006.01) |
| ***H01F 27/29*** | (2006.01) |

(52) U.S. Cl. ..... 336/212; 336/174; 336/175; 336/192

(58) Field of Classification Search ..... 336/174, 336/175, 192, 212

See application file for complete search history.

(56) References Cited

U.S. PATENT DOCUMENTS

| | | | | |
|---|---|---|---|---|
| 2,782,365 | A * | 2/1957 | Castel | 324/221 |
| 4,901,069 | A * | 2/1990 | Veneruso | 340/854.8 |
| 6,684,952 | B2 | 2/2004 | Brockman et al. | |
| 6,903,660 | B2 | 6/2005 | Clark et al. | |
| 6,975,243 | B2 | 12/2005 | Clark et al. | |
| 7,165,618 | B2 | 1/2007 | Brockman et al. | |
| 7,187,297 | B2 | 3/2007 | Clark et al. | |
| 7,225,866 | B2 | 6/2007 | Berchenko et al. | |
| 7,230,542 | B2 | 6/2007 | Smits et al. | |
| 7,277,026 | B2 | 10/2007 | Hall et al. | |
| 2003/0137302 | A1 | 7/2003 | Clark et al. | |
| 2004/0164838 | A1 * | 8/2004 | Hall et al. | 336/234 |

* cited by examiner

*Primary Examiner* — Anh T Mai
*Assistant Examiner* — Ronald W Hinson
(74) *Attorney, Agent, or Firm* — Brandon S. Clark; Rodney Warfford

(57) ABSTRACT

An inductive coupler assembly has a first coupler having a first support structure and plural discrete first ferromagnetic segments supported by the first support structure, and a second coupler to inductively couple to the first coupler, the second coupler having a second support structure and plural discrete ferromagnetic segments supported by the second support structure.

28 Claims, 9 Drawing Sheets

PROVIDING AN INDUCTIVE COUPLER ASSEMBLY HAVING DISCRETE FERROMAGNETIC SEGMENTS

TECHNICAL FIELD

The invention relates to an inductive coupler assembly including a first coupler and a second coupler, each having discrete ferromagnetic segments.

BACKGROUND

To complete a well, various completion equipment is provided in a well. In many cases, the completion equipment includes electrical devices that have to communicate with an earth surface or downhole controller. Traditionally, electrical cables are run to downhole locations to enable such electrical communication. In other implementations, inductive couplers have been used for communicating power and/or signaling to electrical devices downhole in a wellbore and retrieving measurement information to surface.

Typically, an inductive coupler includes two coil elements, a female coil element that is fixed in a downhole position, and a male coil element that is typically run with a tool for positioning adjacent the female coil element to enable inductive coupling between the female and male coil elements. In downhole applications, both the male and female coil elements of an inductive coupler are typically arranged in cylindrical structures. Each of the male and female coil elements includes a pole member (formed of a ferromagnetic material) that is cylindrically shaped. Each coil element has coil wiring that is wound along a circumference of the respective cylindrical pole member.

A side sectional view of an example conventional inductive coupler 10 is depicted in FIG. 1, which shows a cylindrically-shaped female pole member 12 and a cylindrically-shaped male pole member 14. Coil wiring 16 is provided in a circumferential groove 18 defined in the female pole member 12, and coil wiring 20 is provided in a circumferential groove 22 defined in the male pole member 14. Note that the cylindrically-shaped male pole member 14 has an outer diameter that is smaller than an inner diameter of the female pole member 12, such that the male pole member 14 can be lowered into the inner bore of the female pole member 12 to enable inductive coupling between the male and female coil elements. Once the female and male coil elements are aligned, an electrical current is run through one of the coil wirings 16, 20, which creates a magnetic field 24 to induce current to flow in the other of the coil wirings 16, 20.

An issue associated with using a conventional inductive coupler such as that depicted in FIG. 1 is that it may be difficult or not cost-effective to make inductive couplers of different sizes for different applications. Cylindrically-shaped pole members made of certain types of ferromagnetic materials can be mechanically fragile, making the grinding process relatively difficult to achieve coupler elements of different sizes as well as making the inductive coupler easily susceptible to failure due to mechanical shocks or vibrations during deployment downhole or operation within the wellbore. Also, having to provide customized sizes and shapes to achieve coupler elements of different sizes is a time-consuming and labor-intensive process, which can drive up the costs of well operation. Also, an issue associated with conventional inductive couplers is that the ferromagnetic core and the coil element are exposed to well bore fluids which result in corrosion and reduced life span.

SUMMARY

In general, according to an embodiment, an inductive coupler assembly includes a first coupler having a first support structure and plural discrete ferromagnetic segments supported by the first support structure, and a second coupler to inductively couple to the first coupler, where the second coupler has a second support structure and plural discrete ferromagnetic segments supported by the second support structure.

In another embodiment, a ferromagnetic material core and coil can be immersed in a clean fluid chamber and the oil is separated and pressure compensated to the surrounding fluid.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

An inductive coupler assembly according to an embodiment includes first and second couplers, where the first coupler can be considered a male coupler, and the second coupler can be considered a female coupler (in some implementations). The first and second couplers can also be referred to as first and second coil elements that are able to communicate by inductive coupling. However, instead of using concentrically arranged cylindrically-shaped or contiguous ferromagnetic pole members in the couplers, as conventionally done, discrete ferromagnetic segments are employed in each of the first and second couplers. Using discrete ferromagnetic members enables an operator to easily manufacture inductive couplers of different sizes or shapes by using different combinations of discrete ferromagnetic segments. The ability to conveniently provide robust and reliable inductive couplers of different sizes (or shapes) is useful because it allows for a more effective and cost-efficient well operation and provides a means to communicate wellbore measurements and equipment control commands that enable operators to monitor and optimize production operations and reservoir recovery.

Figure 2A:
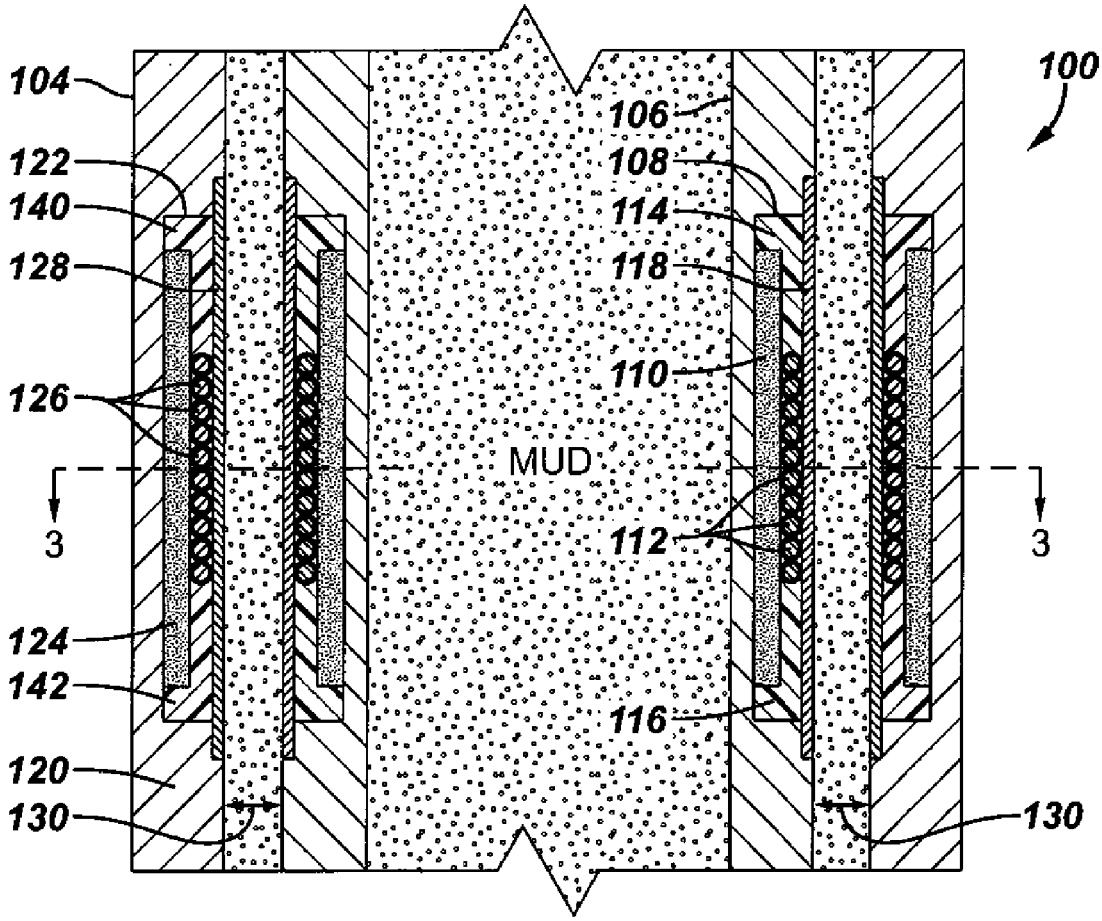
FIG. 2A illustrates a side sectional view of an inductive coupler assembly according to an embodiment.
Figure 2B:
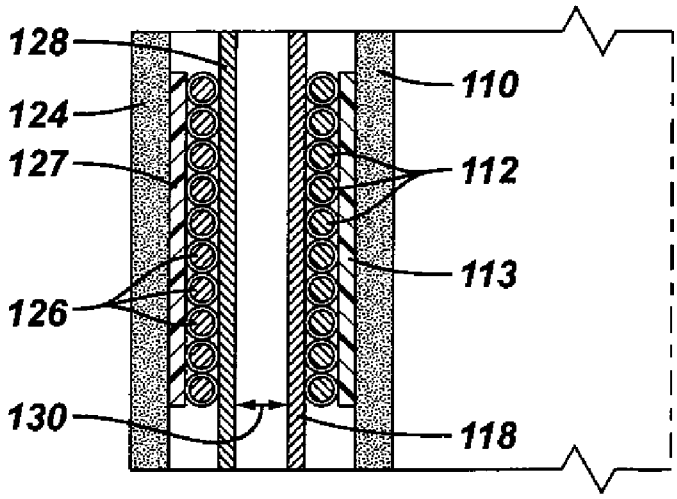
FIG. 2B shows a portion of the inductive coupler assembly of FIG. 2A in greater detail.
Figure 3:
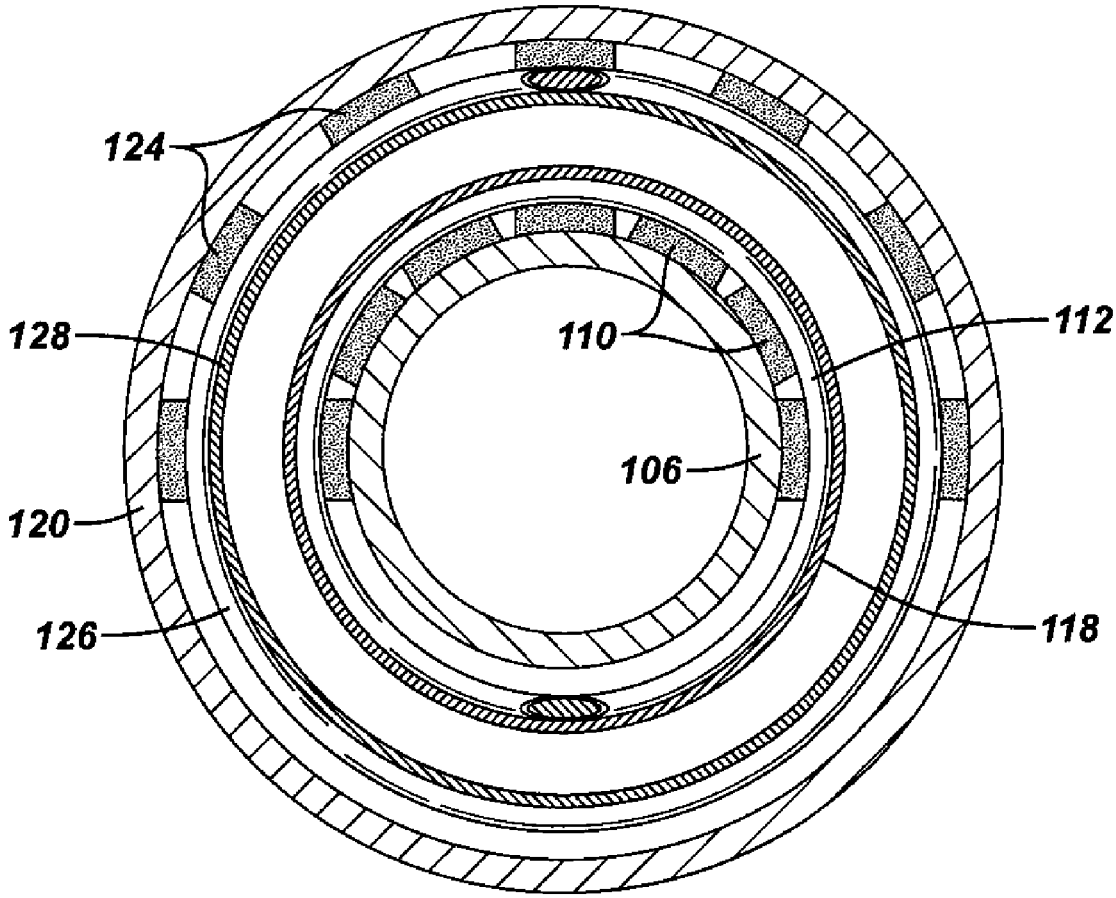
FIG. 3 is a cross-sectional view of the inductive coupler assembly of FIG. 2A.

FIGS. 2A, 2B, and 3 depict an inductive coupler assembly 100 according to an embodiment. FIG. 2A is a side-sectional view of the inductive coupler assembly 100, whereas FIG. 3 is a top cross-sectional view of the inductive coupler assembly 100. The inductive coupler assembly 100 includes a male coupler 102 and a female coupler 104. As depicted in FIGS. 2A and 3, an annular gap 130 is defined between the male and female couplers. The male coupler 102 includes a support structure 106, which can be a steel mandrel or other type of support structure. The support structure 106 is a generally cylindrically-shaped support structure. "Generally cylindrical" means that the structure is not perfectly cylindrical, but rather has a shape that is roughly cylindrical based on tolerances and accuracies of equipment used to manufacture the structure.

A circumferential groove 108 is formed in an outer surface of the support structure 106, where the groove 108 extends generally around the outer circumference of the support structure 106.

In accordance with some embodiments, discrete ferromagnetic segments 110 can be provided in the circumferential groove 108. In one embodiment, the ferromagnetic segments 110 are ferromagnetic bars. The discrete ferromagnetic bars are further depicted in the cross-sectional view of FIG. 3, which shows a number of ferromagnetic bars 110 provided in the groove 108 of the male coupler support structure 106. Note that the number of discrete ferromagnetic segments 110 can be varied for different applications. In some applications, for example, the ferromagnetic segments 110 can be provided all the way around the circumferential groove 108.

Coil wiring 112 is provided to extend circumferentially around the circumferential groove 108 (and also to extend around the discrete ferromagnetic segments 110). A first non-conductive ring 114 is provided between the top ends of the ferromagnetic segments 110 and the support structure 106, and a second non-conductive ring 116 is provided between the lower ends of the ferromagnetic segments 110 and the support structure 106. The non-conductive rings 114, 116 do not conduct electricity.

Also, a cylindrically-shaped sleeve 118 is provided to sealably cover the groove 108 to isolate wellbore fluids (which can be harsh or corrosive) from the coil wiring 112 and the ferromagnetic segments 110. The sleeve 118 can be sealably attached to the support structure 106 to provide a fluid-tight seal. In the depicted embodiment, the coil wiring 112 is positioned between the ferromagnetic segments 110 and the sleeve 118

Similarly, the female coupler 104 also includes a generally cylindrically-shaped support structure 120 in which a circumferential groove 122 is formed in the inner diameter of the female coupler support structure 120. Discrete ferromagnetic segments 124 (which in one example are discrete ferromagnetic bars) are provided at least partially around the circumference of the groove 122 (as better depicted in FIG. 3). Coil wiring 126 is wound around the groove 122. A first non-conducting ring 140 is provided between the top ends of the ferromagnetic segments 124 and the support structure 120, and a second non-conductive ring 142 is provided between the bottom ends of the ferromagnetic segments 124 and the support structure 120. Also, a sleeve 128 is sealably attached to the female coupler support structure 120 to provide a seal to prevent wellbore fluids from entering the groove 122. Note that in the depicted embodiment, the coil wiring 126 is between the ferromagnetic segments 124 and the sleeve 128.

The coil wiring 126 of the female coupler 104 can be wrapped (or wound in a spiral manner) around a bobbin 127 (FIG. 2B), which is made of a magnetically low-permeability and electrically non-conductive material such as Polyetheretherketones (PEEK™). The bobbin 127 is ring-shaped and is provided between the coil wiring 126 and the ferromagnetic segments 124. The coil wiring 112 of the male coupler 102 can be directly wrapped around the ferromagnetic segments 110 or around a ring-shaped bobbin 113 (FIG. 2B), which is made of a low-permeability and non-conductive material such as PEEK.

Examples of ferromagnetic materials for the ferromagnetic segments 110 and 124 that can be used include ferrite. Other ferromagnetic materials can also be used, such as soft iron magnetic alloys, mu-metal alloys, or other materials. A desired property for proper operation of the inductive coupler is that the desired magnetic path that couples the male and female couplers should pass through low-loss magnetic materials and the air gap (or wellbore fluid gap) 130 should be made relatively small. In some implementations, the ferromagnetic segments have a higher magnetic permeability than the adjacent metal alloy that is used for the support structures 106 and 120. Moreover, a low-magnetic permeability material can be used between the support structures 106 and 120 and the ferromagnetic segments to help provide a path of least magnetic reluctance to the desired magnetic field that couples the male and female couplers.

Instead of using bars, the ferromagnetic segments can be laminated bars or sheets, tape-wound sheets, rods, rings, ring segments, bricks, or other structures.

In one embodiment, the ferromagnetic bars are coated with a thermoplastic material such as PEEK or packaged into Teflon® sleeves. This feature gives more protection of the ferromagnetic segments against vibrations and shocks. Also, it avoids any direct mechanical contact between adjacent ferromagnetic segments, which are easily chipped and it provides protection from corrosive well fluids.

The sleeves 118 and 128 are formed of non-magnetic materials. The sleeves help mechanically support and protect respective ferromagnetic segments 110 and 124, since the ferromagnetic segments can be fragile parts. Moreover, the sleeves have a low magnetic permeability; hence, they can help decrease magnetic flux losses into the surrounding metal structures by increasing the magnetic flux reluctance of the undesired magnetic paths. This helps to increase the overall efficiency of the inductive coupler 100.

The geometry of each ferromagnetic segment and each coil wiring can be selected to optimize the coupler efficiency. For example, a substantial length of the ferromagnetic segment can be provided above and below the bobbin 113, 127 to increase the mutual inductance between the male and female couplers 102 and 104.

Note that the coupler efficiency is not dependent at the first order upon the thickness of the ferromagnetic segments, provided that relatively high permeability materials are selected.

As a result, relatively thin ferromagnetic segments can be provided to allow easier fitting into couplers of different geometries.

The ferromagnetic segments 110 of the male coupler 102 and the ferromagnetic segments 126 of the female coupler 104 can be coupled electromagnetically (by inductive coupling) to cause the creation of a closed path of least resistance (or more precisely, least magnetic reluctance) for magnetic flux to flow. The size, number, and placement of the ferromagnetic segments are designed to ensure good electromagnetic coupling for any rotational orientation of the cylindrical support structures 106 and 120.

Figure 4:
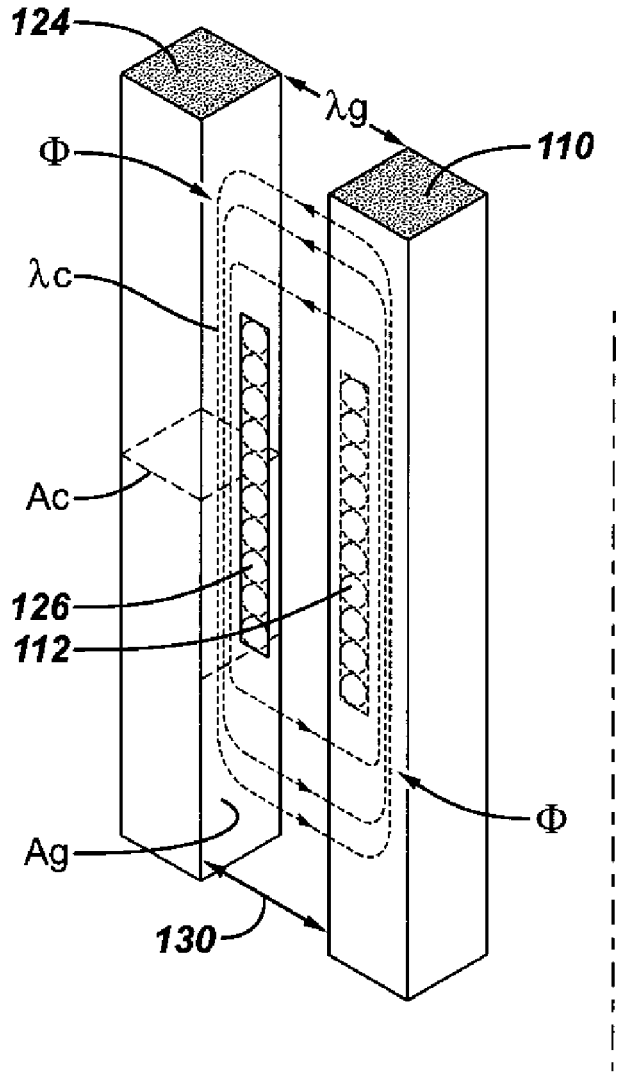
FIG. 4 illustrates formation of a magnetic field using an inductive coupler assembly, according to an embodiment.

As depicted in FIG. 4, the inductive coupler can be considered as a magnetic circuit with ferromagnetic bars 110, 124 and a gap space 130 between the ferromagnetic bars. The gap space 130 is filled with downhole fluids. The magnetic flux $\Phi$ is forced through each ferromagnetic bar and returns via the fluid gap 130. Each ferromagnetic bar provides a relatively high permeability path that guides the flux, whereas the gap 130 has relatively low permeability.

Mathematically, the operation of an inductive coupler may be described according to Faraday's law in the integral form:

$$\oint_C \vec{E}\cdot d\vec{l} = -\frac{d}{dt}\int_S \vec{B}\cdot d\vec{S}. \quad \text{(Eq. 1)}$$

In Eq. 1, B is the magnetic flux coupling the male and female couplers and S is the surface area defined by the inner diameter of the inner coil. Notice that this is a surface area over which the integral is computed. There is no requirement for this surface area to be completely filled by the magnetic material or that the magnetic material within the surface area to be comprised of one contiguous piece of ferromagnetic material. Likewise for the left side of Eq. 1, E is the electric field potential around the closed path, C, defined by the inductive coupling's outermost coils, and $\vec{l}$ is a line vector aligned with the wire as it goes around the closed path C. There is no requirement that the magnetic material within this line integral be continuous, contiguous, cylindrically connected, or symmetric.

In FIG. 4, $A_g$ notes the overlapping area (or gap longitudinal section area) between the two bars, and $A_c$ notes the ferrite bar cross section area.

Figure 5:
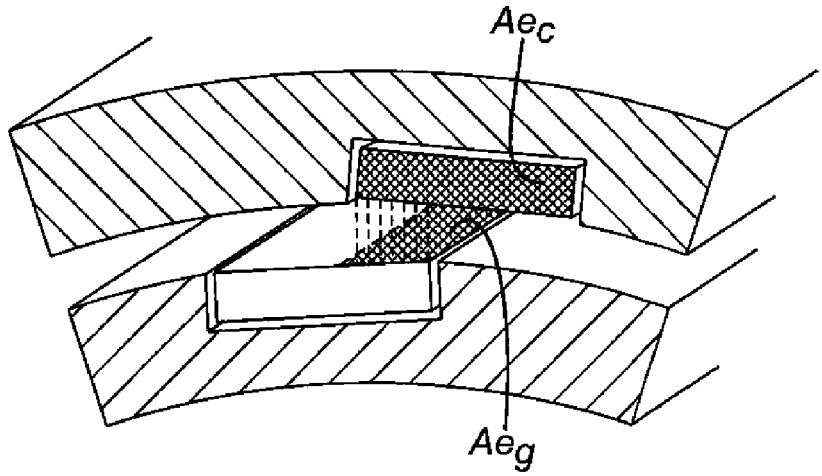
FIG. 5 illustrates inductive coupling achievable even when inductive coupler elements are slightly misaligned, in accordance with an embodiment.

The two ferromagnetic bars in the male and female couplers can tolerate misalignment as depicted in FIG. 5. In this case, $Ae_g$ ($\leqq A_g$) notes the effective cross section area that is common between the two bars. Due to possible misalignment, this effective section is less or equal to the overall cross section as shown in FIG. 4 when the two bars are perfectly aligned. The parameter $Ae_c$ represents the effective cross-section of the ferromagnetic bar, which is equal to $A_c$ in FIG. 4.

The coupler mutual inductance can be computed using the expression of the reluctance of the various elements along the magnetic flux. $R_c$ notes the reluctance of the ferromagnetic core, and $R_g$ notes the reluctance of the fluid gap. As a first order approximation, the following is obtained:

$$R_c=\lambda_c/(\mu_c{*}A_c),$$

$$R_g=\lambda_g/(\mu_g{*}A_g). \quad \text{(Eq. 2)}$$

In Eq. 2 The symbol $\mu_c$ is the magnetic permeability of the ferromagnetic bars or ferromagnetic material and $\mu_g$ is the magnetic permeability of the fluid gap. Magnetic permeability is measured in henries per meter, or newtons per ampere squared. It represents the degree of magnetization of a material that responds linearly to an applied magnetic field.

The parameters $\lambda_c$ and $\lambda_g$ represent the length of magnetic lines in the ferromagnetic bars and in the gap 130, respectively. The parameters $\lambda_c$ and $\lambda_g$ represent the magnetic permeability in the ferromagnetic bars and in the gap, respectively.

Since the inductive coupler is constructed with a set of ferromagnetic bars, the effective reluctance includes the contribution of each bar in the male and female coupler. The contributions of each bar and corresponding fluid gap section are added.

The reluctance in the ferromagnetic core section $R_c$ and in the fluid gap $R_g$ becomes:

$$R_c=\lambda_c/(\mu_c{*}Ae_c),$$

$$R_g=\lambda_g/(\mu_g{*}Ae_g). \quad \text{(Eq. 3)}$$

The total flux is expressed as $\Phi=N_1I/R_c+R_g)$. $N_1$ notes the number of turns in the male coupler.

Since the gap 130 is filled with air or fluid, $\mu_g$ is close to unity. The conditions $\mu_c>>\mu_g$ leads to:

$$\Phi\sim N_1I/R_g=\mu_o N_1 IAe_g/\lambda_g. \quad \text{(Eq. 4)}$$

The constant value $\mu_0$ is known as the magnetic constant or the permeability of vacuum and it has the defined value $\mu_0=4\pi\times10^{-7}$ Newtons per Ampere squared.

The inductive coupling's mutual inductance is equal to the total flux divided by the coil current:

$$M_{12}=N_2\Phi/I, \quad \text{(Eq. 5)}$$

where $N_2$ notes the number of turns on the secondary female coil. Based on Eq. 4, $M_{12}$ becomes:

$$M_{12}=\mu_o N_1 N_2 Ae_g/\lambda_g, \quad \text{(Eq. 6)}$$

It is thus concluded that the mutual inductance depends largely upon the geometrical dimensions of the fluid gap. The mutual inductance depends mainly upon the gap thickness $\lambda_g$ and effective overlapping area $Ae_g$. These parameters are optimized to enhance the mutual impedance between the two couplers and consequently raise the coupler's efficiency.

The coupler's efficiency can be optimized as follows. The coupler's efficiency increases when the gap thickness $\lambda_g$ is reduced. This implies that the inner and outer diameters of the female and male couplers should be as close as possible. The coupler's efficiency also increases when the overlapping area $Ae_g$ is raised. This can be achieved by increasing the length of ferromagnetic segments on both ends of the coupler.

Alternatively, enhanced efficiency can be achieved also by increasing the number of ferromagnetic segments. The coupler efficiency increases also with the wellbore size since the overall gap area is magnified while the gap length or spacing between male and female couplers remains about the same.

The mutual inductance and therefore the coupler's efficiency is not dependant upon the ferromagnetic segment thickness, to a first approximation. This allows selecting thin ferromagnetic bars. The above is true only if the permeability of the ferromagnetic segments is sufficiently high so that the condition $\mu_c>>\mu_g$ is valid.

For optimum efficiency, it is also desired to minimize the interaction between the magnetic field and the metal of the support structures. For this reason, non-conductive rings (114, 116, 140, 142 in FIG. 2) made of thermoplastic material such as PEEK can be placed on both ends of the ferromagnetic bars. These rings between the ferromagnetic bars and surrounding metallic structure reduce eddy current losses in the metal and consequently lead to a more efficient coupling between the two couplers.

Figure 1:
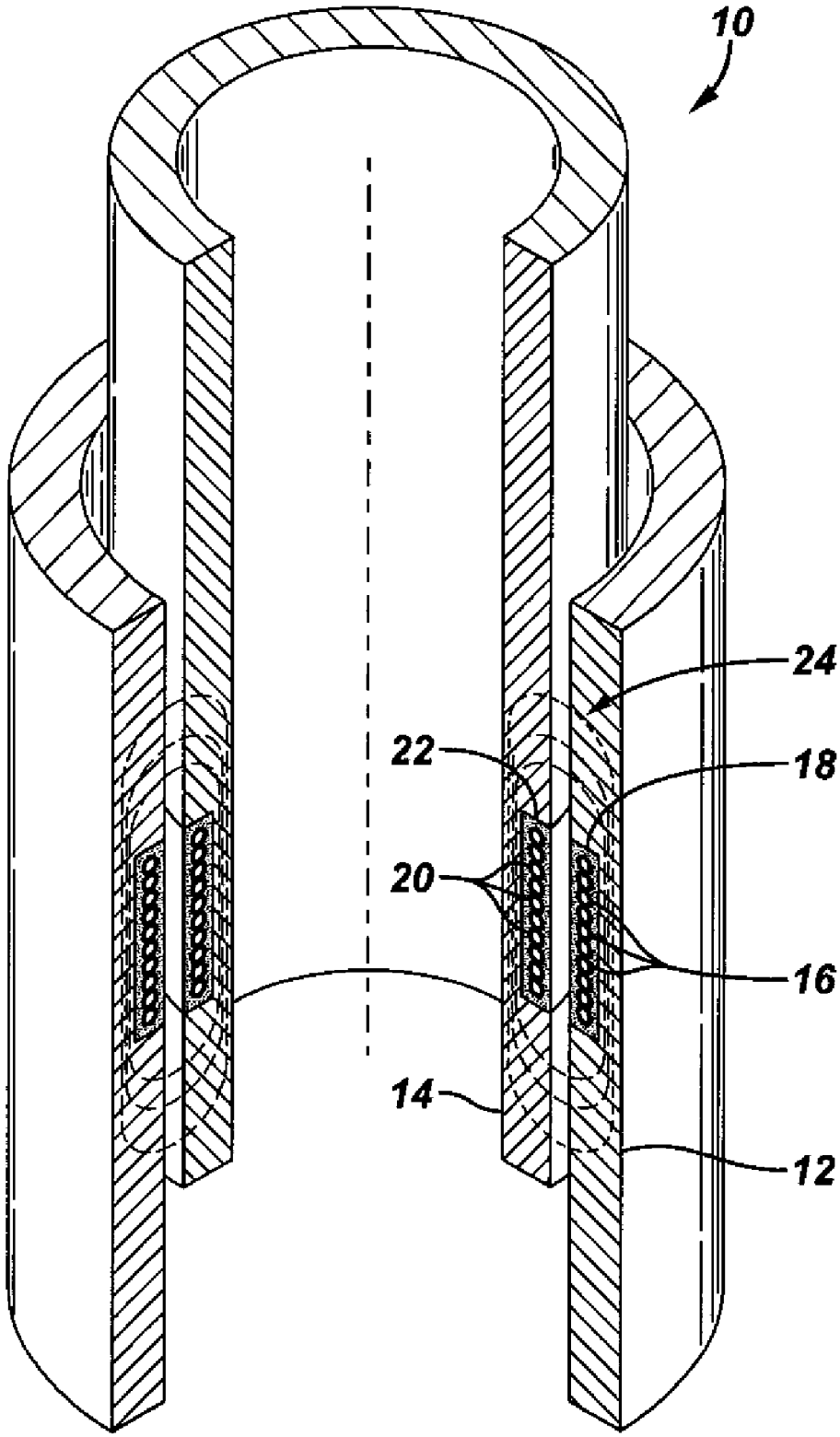
FIG. 1 (Prior Art)
FIG. 1 illustrates a conventional inductive coupler assembly.
Figure 6:
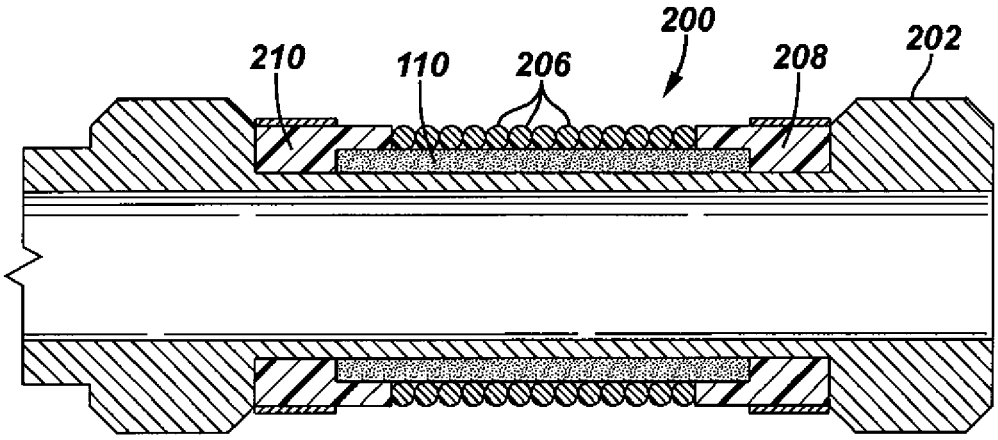
FIG. 6 is a side sectional view of an alternative implementation of a coupler.

FIG. 6 is a longitudinal sectional view of a male coupler of a slightly different embodiment. As with the embodiment depicted in FIGS. 1 and 2, the male coupler 200 includes a support structure 202, which can be a metal mandrel. A groove 204 is formed in the outer surface of the support structure 202, in which discrete ferromagnetic segments 110 are provided. The coil wiring 206 is wrapped around the ferromagnetic segments 110. Although a bobbin is not employed in FIG. 6, note that in other implementations, a bobbin can be provided between the coil wiring 206 and the ferromagnetic segments 110.

The coil wiring 206 can be properly coated to protect against elevated temperature and pressure. Examples of coatings that can be applied include Teflon, PEEK, a mix of polymers, and so forth. The ferromagnetic segments 110 may also be exposed to well fluids. In some cases, the ferromagnetic segments can also be coated with a protective layer. However, in other implementations, such as when the ferromagnetic segments 110 are implemented with a ferrite material, the protective coating may not be necessary since the ferrite material is relatively stable and does not react easily with mud or wellbore fluids.

As further depicted in FIG. 6, non-conductive rings 208 and 210 are provided on the two ends of the ferromagnetic segments 110 to improve coupler efficiency and to reduce the interaction between the magnetic field and the metal of the support structure 202. The rings 208 and 210 can be formed of a material having a relatively low magnetic permeability.

Figure 7:
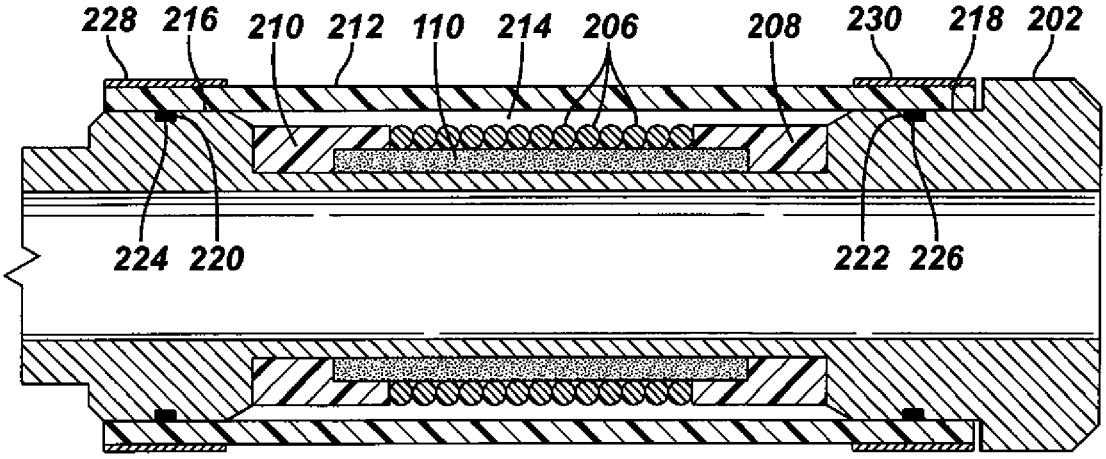
FIG. 7 is a side sectional view of another implementation of a coupler.

As depicted in FIG. 7, for additional protection, a low magnetic permeability sleeve 212 is provided to cover the groove 204, in another embodiment. In this embodiment, a clean oil (or other protective fluid) can be provided in a chamber 214 defined between the sleeve 212 and the support structure 202A. The sleeve 212 is engaged with surfaces 216 and 218 of the support structure 202A, where the surfaces have indentations 220 and 222 to receive seals 224 and 226, such as O-ring seals, to provide a sealed engagement between the sleeve 212 and the support structure 202A. Attachment rings 228 and 230, such as metal rings, can be used to secure the sleeve 212 to the support structure 202A.

The clean oil in the chamber 214 protects the coil wiring 206 from corrosion and reduces the risk of short-circuit in the electrical connections due to presence of water or other corrosive or electrically conductive wellbore fluids. Elastic deformation of the sleeve 212 compensates for expansion and contraction of the oil at various temperatures and pressures. Consequently, the sleeve 212 can be used as a membrane to compensate for changing volume of the system due to variation in temperature and pressure. Protective layers can be provided on the sleeve 212 to protect the sleeve 212 from damage when running a tool including the coupler 200 in the well. The protective layers can be strips, plates, or sheets of metallic materials that do not form a closed electrically conductive loop to avoid short-circuiting the magnetic circuit or redirection of the magnetic field path through the protective layers.

In other implementations, other techniques for compensation for expansion and/or compression of the oil in the chamber 212 can be used, including a pressure compensation bellows, a dynamic O-ring, a compensating piston, and so forth.

The chamber 214 shown is filled with clean oil and compensated for pressure and temperature variation to protect ferromagnetic material segments and coil wiring. However, the same protection method could be used for cylindrical ferromagnetic core and coil wiring (such as that depicted in FIG. 1, for example), toroidal shaped ferromagnetic core, or any other shaped ferromagnetic core and coil wiring.

Figure 8A:
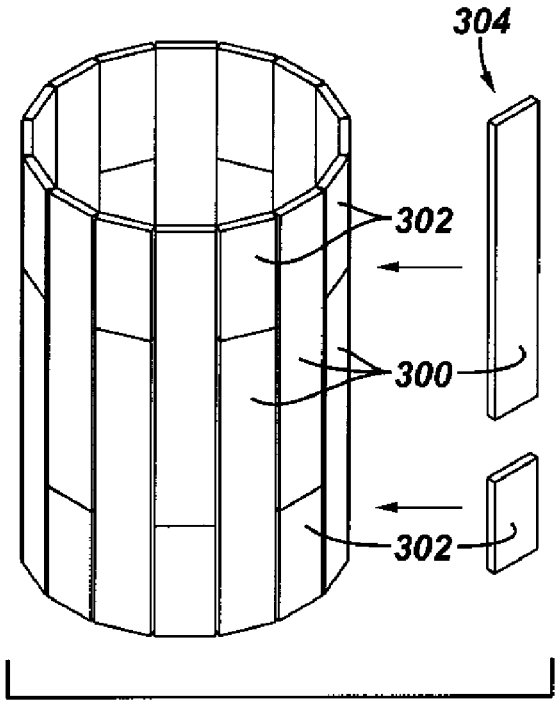
FIGS. 8A, 8B, and 9 illustrate a further embodiment of an inductive coupler assembly.
Figure 8B:
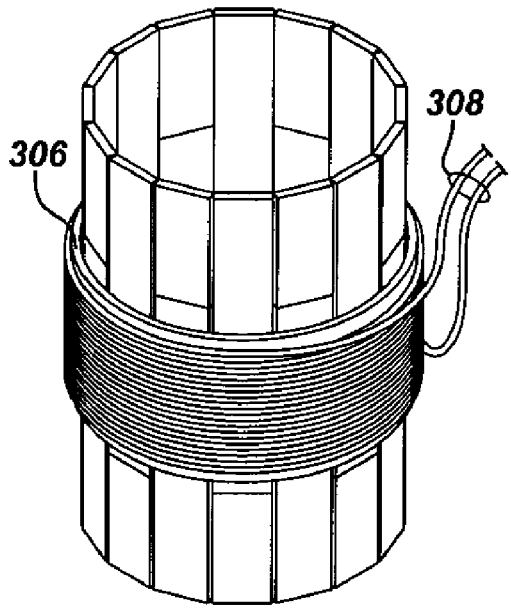
Figure 9:
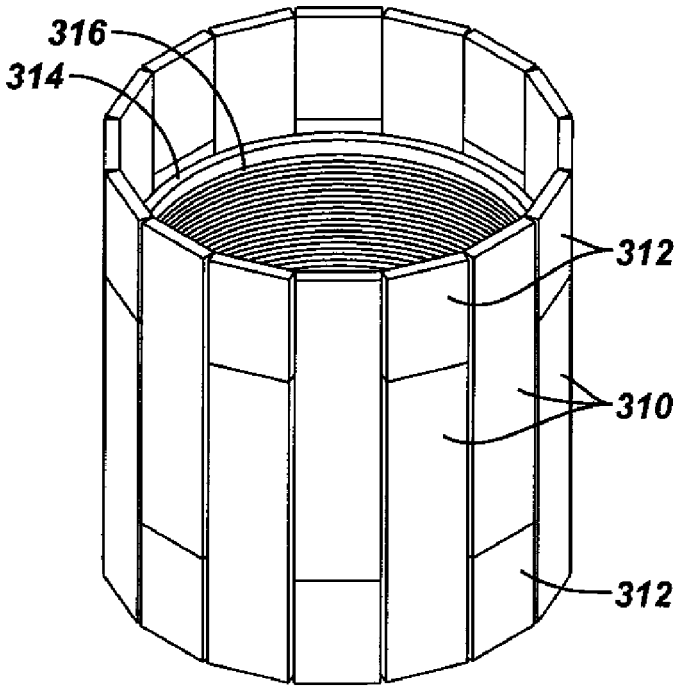

As depicted in FIGS. 8A, 8B, and 9, instead of providing the ferromagnetic segments as discrete segments in the circumferential direction, as depicted above, the ferromagnetic segments can also be discrete in the longitudinal direction. Thus, as depicted in FIG. 5A, a longer length ferromagnetic segment 300 and a shorter length ferromagnetic segment 302 can be provided, where the ferromagnetic segments 300 and 302 can be stacked in the longitudinal direction as depicted. The stacked arrangement of the ferromagnetic segments 300, 302 is referred to as a set 304. Multiple sets 304 of ferromagnetic segments are arranged in the circumference, as depicted in FIG. 8A. In the implementation depicted in FIG. 8A, some of the sets 304 have the longer length ferromagnetic segment 300 stacked on top of the shorter length ferromagnetic segment 302, while other sets 304 have the shorter length ferromagnetic segment 302 stacked on top of the longer length ferromagnetic segment 300. The two different arrangements are provided in alternating fashion, as depicted in FIG. 8A, such that an alternating arrangement of ferromagnetic segments 300, 302 is provided.

The arrangement of ferromagnetic segments, 300, 302 in FIG. 8A can be part of the male inductive coupler. As further depicted in FIG. 8B, a bobbin 306 is provided around the outer surfaces of the ferromagnetic segments 300, 302, and coil wiring 308 is provided around the bobbin 306.

A similar arrangement of longer length and shorter length ferromagnetic segments 310 and 312 are also provided for the female inductive coupler, as depicted in FIG. 9. The ferromagnetic segments 310, 312 are arranged in alternating fashion. A bobbin 314 is placed inside the ferromagnetic segments 310, 312, with the female coupler coil wiring 316 arranged around the bobbin 314 inside the bobbin.

Figure 10:
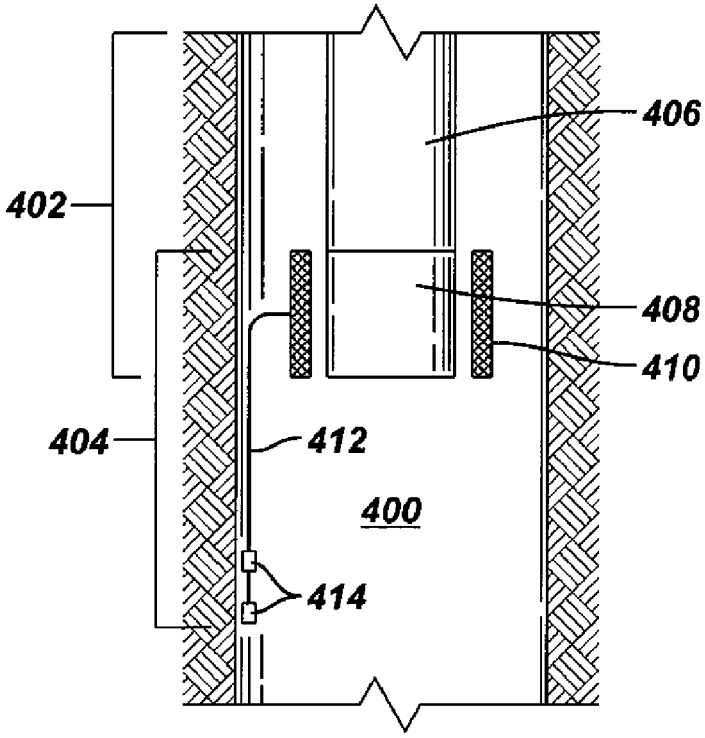
FIG. 10 illustrates an example completion system that uses an embodiment of an inductive coupler assembly.

FIG. 10 shows an example completion system deployed in a wellbore 400. The completion system includes an upper completion section 402, and a lower completion section 404. The upper completion section 402 includes a tubing 406 (e.g., production tubing). A male inductive coupler 408 is provided at the lower end of the tubing 406. The lower completion section 404 has a female inductive coupler 410 that is electrically connected over a cable 412 to electrical devices 414 (e.g., sensors and/or control devices).

The inductive coupler assembly including the couplers 408 and 410 form an inductive coupler assembly, and the couplers 408 and 410 can be arranged as discussed above in the various embodiments. The upper completion section 402 is run into the wellbore 400 and engaged with the lower completion section 404. Once engaged, the male coupler 408 is positioned adjacent the female coupler 410 to enable the couplers to communicate.

Figure 11:
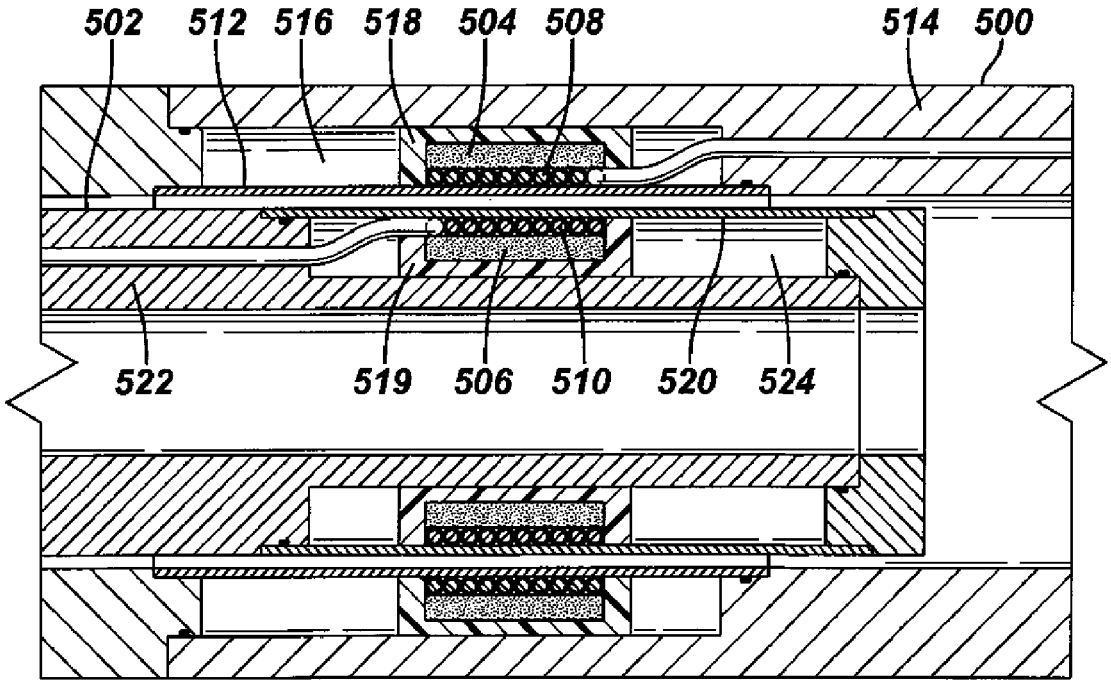
FIGS. 11-14 illustrate other embodiments of inductive coupler assemblies in which clean oil chambers can be employed to protect inductive coupler elements, according to some embodiments.

FIGS. 11-14 illustrate other embodiments of inductive coupler assemblies in which clean oil (or other fluid) chambers are provided to protect inductive coupler elements. As depicted in FIG. 11, a female coupler 500 and a male coupler 502 are provided adjacent each other. The female coupler 500 includes a ferromagnetic core 504, and the male coupler 502 includes a ferromagnetic core 506. Coil wiring 508 is provided around the ferromagnetic core 504 of the female coupler 500, and coil wiring 510 is provided around the ferromagnetic core 506 of the male coupler 502.

As further depicted in FIG. 11, an elastic sleeve 512 is sealably attached to a housing 514 of the female coupler 500, with a sealed chamber 516 containing a clean oil defined between the sleeve 512 and the housing 514. The sleeve 512 can be formed of PEEK, for example. Also, optionally, a PEEK coating 518 can be provided around the ferromagnetic core 504 and the coil wiring 508, and another PEEK coating 519 can be provided around the ferromagnetic core 506 and the coil wiring 510.

Similarly, an elastic sleeve 520 (which can be made of PEEK, for example) is sealably attached to a housing 522 of the male coupler 502 to define a chamber 524 containing a clean oil between the sleeve 520 and the housing 522.

Figure 12:
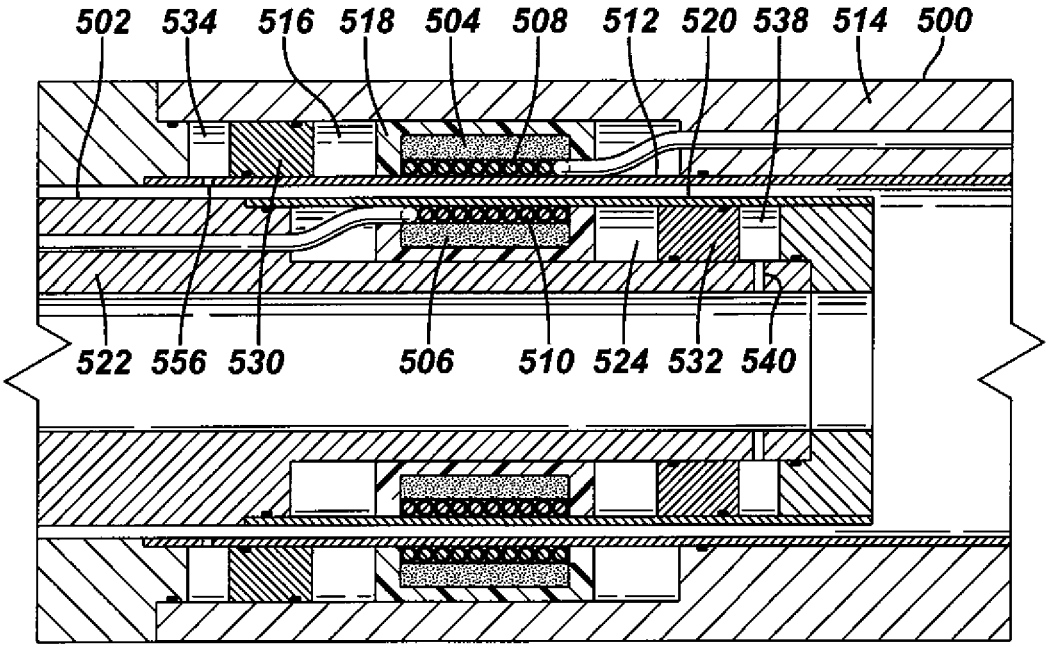

FIG. 12 shows an inductive coupler assembly that is similar to the inductive coupler assembly of FIG. 11, except that compensating pistons 530 (in the female coupler 500) and 532 (in the male coupler 502) are provided. The compensating pistons 530 and 532 are moveable to compensate for expansion and compression of the clean oil in respective chambers 516 and 524.

As depicted in FIG. 12, the piston 530 is movable in a space between the sleeve 512 and housing 514 of the female coupler 500. One end of the piston 530 is exposed to the chamber 516, while the other end of the piston 530 is exposed to another chamber 534. A port 536 is provided in the sleeve 512 to allow for fluid communication between the chamber 534 and an exterior space outside the female coupler 500.

Similarly, the piston 532 is movable in a space between the sleeve 520 and the housing 522 of the male coupler 502. One end of the piston 532 is exposed to the chamber 524, while another end of the piston 532 is exposed to another chamber 538 that communicates with a port 540 to an external space outside the male coupler 502.

Figure 13:
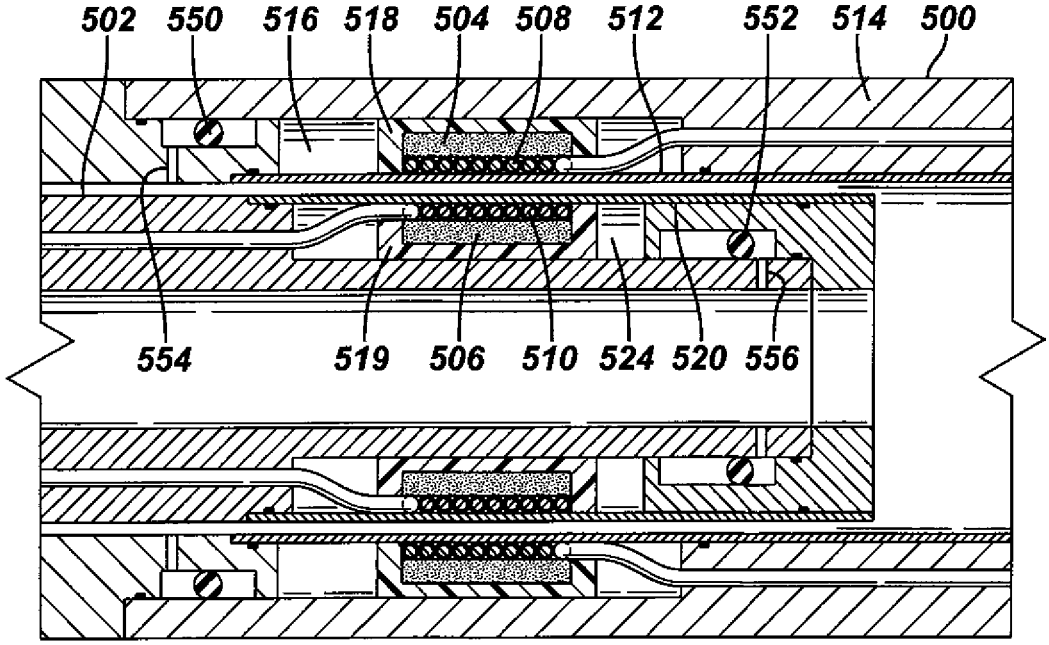

FIG. 13 illustrates use of a different compensating mechanism in the inductive coupler assembly. The inductive coupler assembly of FIG. 13 is similar to the inductive coupler assembly of FIGS. 11 and 12 except that moveable O-ring seals are used to provide compensation for expansion of clean fluids in respective chambers 516 and 524. O-ring seals 550 and 552 are provided in the female coupler 500 and male coupler 502, respectively, with the O-ring seals 550 and 552 exposed through respective ports 554 and 556 to an external space outside the inductive coupler assembly. The O-ring seals 550 and 552 are moveable to compensate for expansion and compression of fluids in respective chambers 516 and 524.

Figure 14:
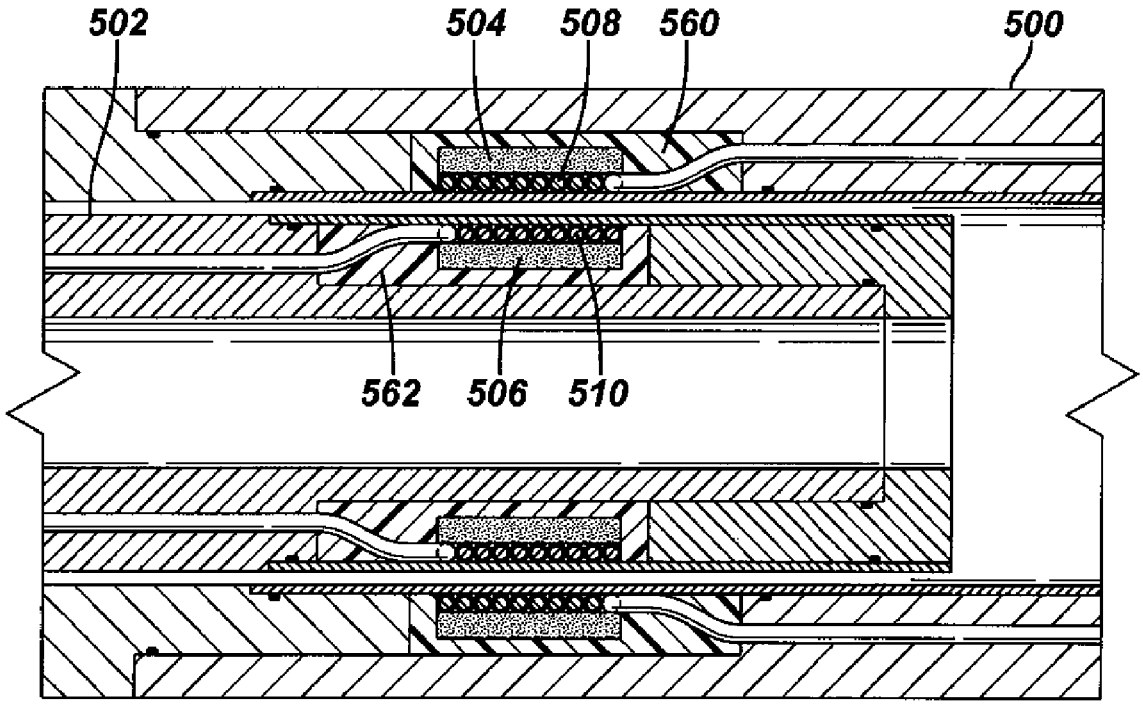

FIG. 14 shows another embodiment of an inductive coupler assembly that includes the female coupler 500 and male coupler 502. The inductive coupler assembly of FIG. 14 is similar to the inductive coupler assembly of FIG. 11, except that the ferromagnetic cores 504 and 506 and coil wirings 508 and 510 of the respective couplers 500 and 502 are potted (provided in protective vessels 560 and 562) to protect the ferromagnetic cores and wiring coils from corrosive well fluids. The potting (protective vessels 560 and 562) can be formed of any non-electrically conductive potting material that is compatible with the insulated coil wirings. Example potting materials include epoxy, a thermoplastic such as PEEK, an elastomer, and so forth.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An inductive coupler assembly, comprising:

a first coupler having a first support structure and plural discrete first ferromagnetic segments supported by the first support structure, wherein each of the plural discrete first ferromagnetic segments extends less than an entire circumference of the first support structure, wherein the plural discrete first ferromagnetic segments are positioned side by side along the circumference of the first support structure; and a second coupler to inductively couple to the first coupler, the second coupler having a second support structure and plural discrete second ferromagnetic segments supported by the second support structure, wherein each of the plural discrete second ferromagnetic extends less than an entire circumference of the second support structure, wherein the plural discrete second ferromagnetic segments are positioned side by side along the circumference of the second support structure.

2. The inductive coupler assembly of claim 1, wherein the discrete ferromagnetic segments of the first and second inductive couplers comprise ferromagnetic bars.

3. The inductive coupler assembly of claim 2, wherein each of the first and second support structures comprise generally cylindrical support structures.

4. The inductive coupler assembly of claim 3, wherein the ferromagnetic bars are arranged along the circumference of corresponding first and second generally cylindrical support structures.

5. The inductive coupler assembly of claim 1, wherein the first and second support structures comprise first and second metal support structures.

6. The inductive coupler assembly of claim 1, wherein the first coupler further has coil wiring around the discrete first ferromagnetic segments of the first coupler, and the second coupler further has coil wiring around the discrete second ferromagnetic segments of the second coupler.

7. The inductive coupler assembly of claim 6, wherein the first coupler further has a first sleeve sealably attached to the first support structure to protect the first ferromagnetic segments and coil wiring of the first coupler, and the second coupler further has a second sleeve sealably attached to the second support structure to protect the second ferromagnetic segments and coil wiring of the second coupler.

8. The inductive coupler assembly of claim 6, wherein the first coupler has first and second non-conductive rings between the upper and lower ends, respectively, of the first ferromagnetic segments and the first support structure, and wherein the second coupler further has first and second non-conductive rings between the upper and lower ends, respectively, of the second ferromagnetic segments and the second support structure.

9. The inductive coupler assembly of claim 1, wherein the first ferromagnetic segments have shorter length ferromagnetic segments and longer length ferromagnetic segments stacked longitudinally, and the second ferromagnetic segments have shorter length ferromagnetic segments and longer length ferromagnetic segments stacked longitudinally.

10. The inductive coupler assembly of claim 9, wherein the longer length and shorter length ferromagnetic segments of the first coupler are arranged in alternating fashion, and wherein the longer length and shorter length ferromagnetic segments of the second coupler are arranged in alternating fashion.

11. A method to enable communications in a wellbore, comprising:

providing a first coupler having a first support structure and plural discrete first ferromagnetic segments supported by the first support structure, wherein each of the first ferromagnetic segments extends less than an entire circumference of the first support structure, wherein the plural discrete first ferromagnetic segments are positioned side by side along the circumference of the first support structure;

providing a second coupler having a second support structure and plural discrete second ferromagnetic segments supported by the second support structure, wherein each of the second ferromagnetic segments extends less than an entire circumference of the second support structure, wherein the plural discrete second ferromagnetic segments are positioned side by side along the circumference of the second support structure; and moving the first coupler proximate the second coupler to enable inductive coupling between the first and second couplers.

12. The method of claim 11, further comprising selecting a number of discrete first ferromagnetic segments and a number of discrete second ferromagnetic segments to provide for first and second couplers of target sizes.

13. The method of claim 12, wherein the first coupler has a first circumferential groove, and the second coupler has a second circumferential groove, the method further comprising arranging the first ferromagnetic segments side by side in the first circumferential groove, and arranging the second ferromagnetic segments side by side in the second circumferential groove, wherein each of the first ferromagnetic segments extends less than the entire circumference of the first circumferential groove, and wherein each of second ferromagnetic segments extends less than the entire circumference of the second circumferential groove.

14. The method of claim 11, wherein the first coupler has first coil wiring around the first ferromagnetic segments, and the second coupler has second coil wiring around the second ferromagnetic segments, the method further comprising providing electrical current to one of the first and second coil wirings to induce an electrical current in the other of the first and second coil wirings.

15. The method of claim 11, wherein the first and second support structures are first and second metal support structures, the method further comprising:

arranging the first ferromagnetic segments in a circumferential groove of the first metal support structure; and arranging the second ferromagnetic segments in a circumferential groove of the second metal support structure.

16. A completion system comprising:

a first completion section having a first coupler, the first coupler comprising a first support structure and plural discrete first ferromagnetic segments supported by the first support structure, wherein each of the first ferromagnetic segments extends in a circumferential direction less than an entire circumference of the first support structure, wherein the plural discrete first ferromagnetic segments are positioned side by side along the circumference of the first support structure; and a second completion section for engagement with the first completion section, the second completion section having a second coupler to inductively couple to the first coupler, the second coupler having a second support structure and plural discrete second ferromagnetic segments supported by the second support structure, wherein each of the second ferromagnetic segments extends in a circumferential direction less than an entire circumference of the second support structure, wherein the plural discrete second ferromagnetic segments are positioned side by side along the circumference of the second support structure.

17. The completion system of claim 16, wherein the first coupler has a first circumferential groove in which the first ferromagnetic segments are arranged, and the second coupler has a second circumferential groove in which the second ferromagnetic segments are arranged, wherein each of the first ferromagnetic segments extends less than the entire circumference of the first circumferential groove, and wherein each of second ferromagnetic segments extends less than the entire circumference of the second circumferential groove.

18. The completion system of claim 17, wherein the first coupler further has a first coil wiring around the first ferromagnetic segments, and the second coupler further has a second coil wiring around the second ferromagnetic segments.

19. The completion system of claim 18, wherein the first coupler has a first sleeve to sealably attach to the first support structure to cover the first ferromagnetic segments and the first coil wiring, and the second coupler has a second sleeve sealably attached to the second support structure to cover the second ferromagnetic segments and the second coil wiring.

20. The completion system of claim 16, wherein the first and second ferromagnetic segments comprise first and second ferrite segments.

21. The completion system of claim 16, wherein the first and second support structures comprise first and second metal support structures.

22. An inductive coupler assembly, comprising:

a first coupler having a first support structure and a first ferromagnetic core and first coil wiring supported by the first support structure, wherein the first ferromagnetic core includes a plurality of discrete first ferromagnetic segments arranged side by side along a circumference of the first support structure, wherein each of the first ferromagnetic segments extends less than the entire circumference of the first support structure; and a second coupler to inductively couple to the first coupler, the second coupler having a second support structure and a second ferromagnetic core and second coil wiring supported by the second support structure, wherein the second ferromagnetic core includes a plurality of discrete second ferromagnetic segments arranged side by side along a circumference of the second support structure, wherein each of the second ferromagnetic segments extends less than the entire circumference of the second support structure; and a chamber in at least one of the first and second couplers containing a protective fluid to surround the respective ferromagnetic core and coil wiring.

23. The inductive coupler assembly of claim 22, wherein the at least one of the first and second couplers comprises an elastically deformable non-magnetic material sleeve to define the chamber, the sleeve providing separation between the protective fluid and wellbore fluid, and the sleeve compensating for expansion and compression of the protective fluid.

24. The inductive coupler assembly of claim 22, wherein the at least one of the first and second couplers comprises a piston movable to compensate for expansion and compression of the protective fluid.

25. The inductive coupler assembly of claim 22, wherein the at least one of the first and second couplers comprises an elastomer O-ring movable to provide compensation for expansion and compression of the protective fluid.

26. The method of claim 11, wherein providing the first coupler comprises arranging the plural first ferromagnetic segments side by side along the circumference of the first support structure, and wherein providing the second coupler comprises arranging the plural second ferromagnetic segments side by side along the circumference of the second support structure.

27. The completion system of claim 16, wherein the plural discrete first ferromagnetic segments are positioned side by side along the circumference of the first support structure, and wherein the plural discrete second ferromagnetic segments are positioned side by side along the circumference of the second support structure.

28. The inductive coupler assembly of claim 22, wherein the discrete first ferromagnetic segments are ferromagnetic bars, and the discrete second ferromagnetic segments are ferromagnetic bars.

* * * * *